US007873289B2

(12) United States Patent
Shin

(10) Patent No.: US 7,873,289 B2
(45) Date of Patent: Jan. 18, 2011

(54) IMAGE FORMING APPARATUS AND METHOD TO CONTROL A VELOCITY RATIO THEREOF

(75) Inventor: Joong-gwang Shin, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 445 days.

(21) Appl. No.: 12/025,191

(22) Filed: Feb. 4, 2008

(65) Prior Publication Data

US 2008/0310868 A1 Dec. 18, 2008

(30) Foreign Application Priority Data

Jun. 14, 2007 (KR) ..... 10-2007-0058246

(51) Int. Cl.
*G03G 15/00* (2006.01)

(52) U.S. Cl. ..... 399/43

(58) Field of Classification Search ..... 399/43, 399/167, 236; 347/140
See application file for complete search history.

(56) References Cited

U.S. PATENT DOCUMENTS 5,333,037 A * 7/1994 Inoue et al. ..... 399/49
2001/0026696 A1* 10/2001 Yokota et al. ..... 399/57
2006/0127133 A1* 6/2006 Suzuki ..... 399/167

FOREIGN PATENT DOCUMENTS

JP 11-338204 12/1999

* cited by examiner

*Primary Examiner*—David P Porta
*Assistant Examiner*—Kiho Kim
(74) *Attorney, Agent, or Firm*—Stanzione & Kim, LLP

(57) ABSTRACT

An image forming apparatus and a method to control a velocity ratio thereof. The image forming apparatus includes a developing device to rotate opposite a photoconductive medium and to supply the photoconductive medium with a developer, and a controller to control a velocity ratio of the developing device to the photoconductive medium according to an accumulated number of printed copies.

18 Claims, 7 Drawing Sheets

FIG. 4A

| VELOCITY RATIO | OD | $\triangle OD_{2.0}$ |
|---|---|---|
| 1.2 | 0.8 | 0.8-1.42 = -0.62 |
| 1.3 | 0.9 | 0.9-1.42 = -0.52 |
| 1.4 | 1.0 | 1.0-1.42 = -0.42 |
| 1.5 | 1.13 | 1.13-1.42 = -0.29 |
| 1.6 | 1.18 | 1.18-1.42 = -0.24 |
| 1.7 | 1.22 | 1.22-1.42 = -0.2 |
| 1.8 | 1.3 | 1.3-1.42 = -0.12 |
| 1.9 | 1.39 | 1.39-1.42 = -0.03 |
| 2.0 | 1.42 | 1.42-1.42 = 0 |

FIG. 4B

| VELOCITY RATIO | OD | $\triangle OD_{1.4}$ |
|---|---|---|
| 1.2 | 0.8 | 0.8-1.0 = -0.2 |
| 1.3 | 0.9 | 0.9-1.0 = -0.1 |
| 1.4 | 1.0 | 1.0-1.0 = 0 |
| 1.5 | 1.13 | 1.13-1.0 = 0.13 |
| 1.6 | 1.18 | 1.18-1.0 = 0.18 |
| 1.7 | 1.22 | 1.22-1.0 = 0.22 |
| 1.8 | 1.3 | 1.3-1.0 = 0.3 |
| 1.9 | 1.39 | 1.39-1.0 = 0.39 |
| 2.0 | 1.42 | 1.42-1.0 = 0.42 |

FIG. 6

| NUMBER OF PRINTED COPIES | OD | △OD | REFERENCE VELOCITY RATIO(2.0) | REFERENCE VELOCITY RATIO(1.4) |
|---|---|---|---|---|
| 1 | 1 | 1-1 = 0 | 2.0 | 1.4 |
| ⋮ | ⋮ | ⋮ | ⋮ | ⋮ |
| 10,000 | 1.1 | 1.1-1 = 0.1 | ABOUT 1.81 | 1.3 |
| ⋮ | ⋮ | ⋮ | ⋮ | ⋮ |
| 20,000 | 1.18 | 1.18-1 = 0.18 | ABOUT 1.72 | ABOUT 1.22 |
| ⋮ | ⋮ | ⋮ | ⋮ | ⋮ |
| 30,000 | 1.25 | 1.25-1 = 0.25 | ABOUT 1.6 | |
| ⋮ | ⋮ | ⋮ | ⋮ | |
| 40,000 | 1.37 | 1.37-1 = 0.37 | ABOUT 1.43 | |
| ⋮ | ⋮ | ⋮ | ⋮ | |
| 50,000 | 1.42 | 1.42-1 = 0.42 | ABOUT 1.4 | |

IMAGE FORMING APPARATUS AND METHOD TO CONTROL A VELOCITY RATIO THEREOF

CROSS-REFERENCE TO RELATED APPLICATIONS

This application claims priority under 35 U.S.C. §119(a) from Korean Patent Application No. 10-2007-0058246, filed on Jun. 14, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus and a method to control a velocity ratio thereof, and more particularly, to an image forming apparatus which adaptively controls a velocity ratio of a developing device to a photoconductive medium according to an accumulation of a number of printed copies, and a method to control a velocity ratio thereof.

2. Description of the Related Art

An image forming apparatus using a two-component developer composed of a magnetic carrier and a non-magnetic toner develops an electrostatic latent image formed on a photoconductive medium with charged toner. In general, the image forming apparatus prints a fixed number of copies (for example, from 5,000 sheets to 50,000 sheets) using the two-component developer contained therein during a life cycle.

During their life cycles, the carrier, the toner, and the photoconductive medium used in forming an image are degraded, and consequently, there occurs deterioration of the image formed. Particularly, as more printing operations are performed, the less the carrier and the toner are charged. Also, a quantity of electric charge decreases as the number of printed copies increases, and thus, an optical density (OD) measured from an image printed on the paper increases, which deteriorates printing quality. This is because the OD is inversely proportional to the quantity of electric charge.

In order to remove a remainder of toner from the photoconductive medium, a cleaning blade is used. However, the cleaning blade causes abrasion on a film of the photoconductive medium. Accordingly, an amount of image developing increases, an amount of toner charging decreases, OD gradually darkens, and problems, such as blurring or scattering, become more severe. Herein, the scattering problem refers to toner that contaminates an inside portion of a printer engine rather than being used in developing the image on the photoconductive medium. As a result, an image quality of a conventional image forming apparatus deteriorates.

SUMMARY OF THE INVENTION

The present general inventive concept provides an image forming apparatus capable of maintaining an optical density (OD) in a predetermined range regardless of an accumulation of a number of printed copies, and also capable of minimizing blurring and scattering problems, and a method to control a velocity ratio thereof.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a printing control apparatus, including a developing device to rotate opposite a photoconductive medium and to supply the photoconductive medium with a developer, and a controller to control a velocity ratio of the developing device to the photoconductive medium according to an accumulated number of printed copies.

As the accumulated number of printed copies increases, the controller may decrease the velocity ratio by decreasing a velocity of the developing device.

The image forming apparatus may further include a storage unit to store the velocity ratio of the developing device to the photoconductive medium with respect to the number of printed copies, and the controller may control the velocity ratio based on the velocity ratio stored for the number of printed copies.

The image forming apparatus may further include a driving unit to drive the developing device, and the controller may determine a velocity ratio corresponding to the accumulated number of printed copies with reference to the storage unit, and may control the driving unit to drive the developing device at a velocity corresponding to the determined velocity ratio.

The velocity ratio stored for the number of printed copies may be inversely proportional to the number of printed copies.

The velocity ratio stored for the number of printed copies may be calculated based on a variation amount of an optical density (OD) with respect to the number of printed copies, and a variation amount of the OD with respect to a velocity ratio.

The image forming apparatus may further include a counter to count the accumulated number of printed copies.

The foregoing and/or other aspects and utilities of the general inventive concept may also be achieved by providing a method to control a velocity ratio of an image forming apparatus, the method including supplying developer to a photoconductive medium with a developer using a rotating developing device facing the photoconductive medium and controlling a velocity ratio of the developing device to the photoconductive medium according to an accumulated number of printed copies.

The controlling of the velocity ratio may include decreasing the velocity ratio by decreasing a velocity of the developing device as the accumulated number of printed copies increases.

The method may further include storing the velocity ratio of the developing device to the photoconductive medium with respect to the number of printed copies, prior to supplying the developer, and the controlling of the velocity ratio may include controlling the velocity ratio based on the velocity ratio stored for the number of printed copies.

The controlling of the velocity ratio may include determining a velocity ratio corresponding to the accumulated number of printed copies with reference to the velocity ratio stored for the number of printed copies; and driving the developing device at a velocity corresponding to the determined velocity ratio.

The method may further include counting the accumulated number of printed copies, and the controlling of the velocity ratio may include determining the accumulated number of printed copies based on the result of counting the number of printed copies.

The foregoing and/or other aspects and utilities of the general inventive concept may also be achieved by providing an image forming apparatus, including a photosensitive medium to form a latent image, a developing unit to develop the latent image, a counter to count the number of images formed, and a controller to decrease a velocity ratio of the developing unit to the photosensitive medium as a number of images formed increases.

The image forming apparatus may further include a storage unit to store a plurality of control velocity ratios corresponding to a change in optical density with respect to an initial velocity ratio and a plurality of values representing an increase in optical density according to an increase in a number of images formed, wherein the controller decreases the initial velocity ratio to one of the plurality of control velocity ratios such that a decrease in optical density due to changing the initial velocity ratio to the control velocity ratio compensates for the increase in optical density due to the increase in the number of images formed.

The foregoing and/or other aspects and utilities of the general inventive concept may also be achieved by providing a method to control a velocity ratio of a developing device to a photoconductive medium usable in an image forming apparatus, the method including determining a plurality of control velocity ratio corresponding to changes in optical density of an image formed with respect to an initial velocity ratio, determining an increase in optical density according to an increase in a number of images formed, and selecting a control velocity ratio to change the initial velocity ratio to the selected control velocity ratios such that the change in optical density due to the change in velocity ratio compensates for the increase in optical density due to the increase in the number of images formed.

The method may further include storing the plurality of control velocity ratios and values representing the increase in optical density according to the increase in the number of images formed, and using the stored values and control velocity ratios to select the control velocity ratio.

The stored values and control velocity ratios may be preinstalled in the image forming apparatus.

The foregoing and/or other aspects and utilities of the general inventive concept may also be achieved by providing a method of controlling a velocity ratio of an image forming apparatus, including controlling a developing device and a photosensitive medium to rotate at a first velocity ratio, counting a number of images formed, and controlling the developing device and the photosensitive medium to rotate at a second velocity ratio, wherein a change in optical density of the image formed due to a change in the velocity ratio compensates for an increase in optical density due to an increase in the number of images formed.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIGS. 4A and 4B are tables illustrating a ΔOD-reference velocity ratio with respect to a reference velocity ratio according to an exemplary embodiment of the present general inventive concept;

FIG. 6 is a table illustrating the OD for the number of printed copies illustrated in FIG. 5, and the OD and ΔOD which increase with an increased number of printed copies according to an exemplary embodiment of the present general inventive concept.

DETAILED DESCRIPTION OF THE PREFERRED EMBODIMENTS

Figure 1:
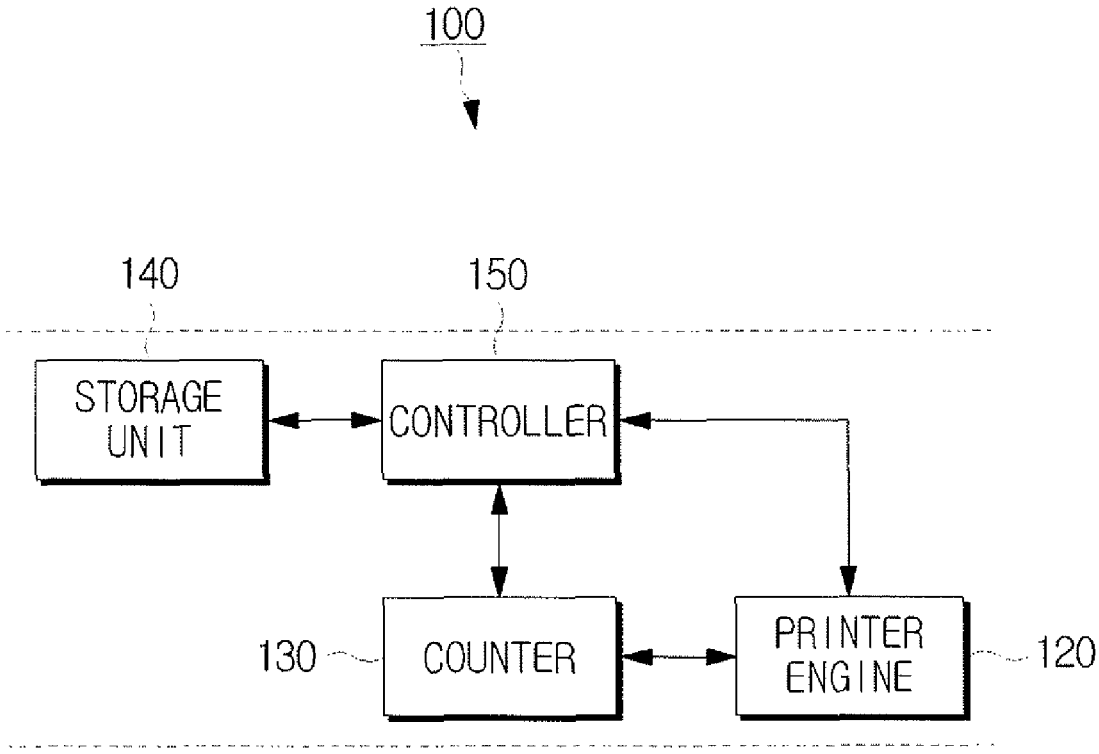
FIG. 1 is a block diagram illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to the like units throughout. The embodiments are described below in order to explain the present general inventive concept by referring to the figures.

Figure 2:
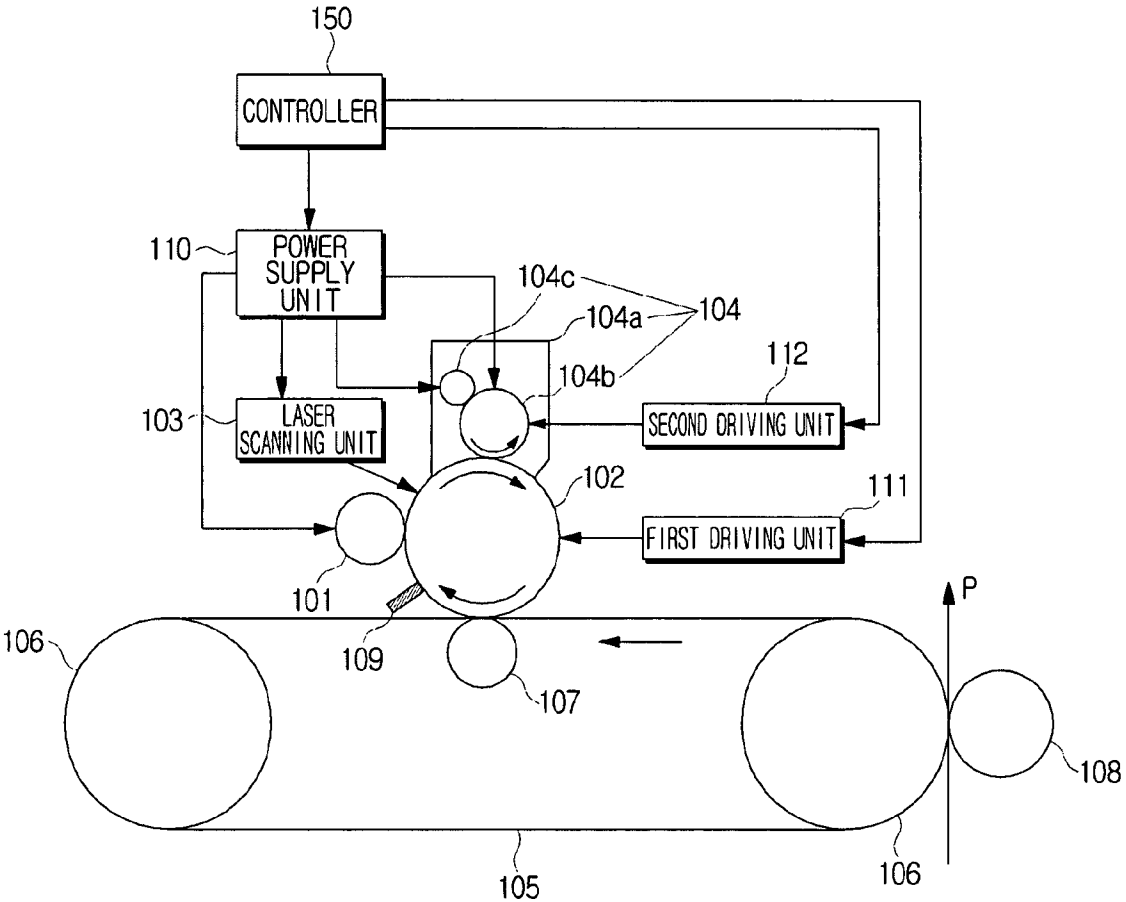
FIG. 2 is a view illustrating a printer engine of FIG. 1.

FIG. 1 is a block diagram illustrating an image forming apparatus according to an exemplary embodiment of the present general inventive concept, and FIG. 2 is a view illustrating a printer engine of FIG. 1.

Referring to FIG. 1, an image forming apparatus 100 according to an exemplary embodiment of the present general inventive concept may include a printer engine 120, a counter 130, a storage unit 140, and a controller 150.

The printer engine 120 is a unit to form a real image on paper P picked-up by a pick-up roller (not illustrated), and may include a charging roller 101, a photoconductive medium 102, a laser scanning unit 103, a developing unit 104, an intermediate transfer belt 105, a support roller 106, a first transfer roller 107, a second transfer roller 108, a cleaning blade 109, a power supply unit 110, a first driving unit 111, and a second driving unit 112.

The charging roller 101 can rotate in contact with a surface of the photoconductive medium 102 or in a non-contact manner to charge the surface of the photoconductive medium 102 uniformly. For example, with a high negative voltage, such as −700V.

If the surface of the photoconductive medium 102 is charged by the charging roller 101, the photoconductive medium 102 forms an electrostatic latent image on a portion scanned with lasers by the laser scanning unit 103, and allows a developer, such as toner, to be attached onto the electrostatic latent image.

The laser scanning unit 103 scans the charged photoconductive medium 102 with a laser corresponding to image information, thereby allowing the electrostatic latent image to be formed. The laser scanning unit 103 may use a laser diode as a light source.

The developing unit 104 develops the electrostatic latent image formed on the photoconductive medium 102 with the developer, and may include a container 104*a*, a developing device 104*b*, and a supply roller 104*c*. The container 104*a* contains therein a developing solution in which a developer, such as a non-magnetic toner, is charged with an electric charge, such as a negative (−) electric charge, is mixed with a carrier, such as a magnetic carrier, charged with an opposite electric charge, such as a positive (+) electric charge.

The developing device 104*b* is disposed to face the photoconductive medium 102 and supplies the photoconductive medium 102 with toner, thereby developing the electrostatic latent image into a toner image. The developing device 104*b* may be a cylindrical roller (type 1) or a combination roller (type 2) having at least one support roller and a belt or tube disposed around the outer circumference of the support roller.

The type 1 is illustrated in FIG. 2 by way of an example. The type 2 may alternatively have a belt, such as an intermediate transfer belt, disposed on an outer part of at least one support roller, to supply the toner to the photoconductive medium 102 through the belt.

The supply roller 104*c* uses an electrostatic force exerted between the supply roller 104*c* and the developing device 104*b* to attach the developing solution onto the surface of the developing device 104*b*, thereby forming a developer layer, that is, a toner layer. Also, a trimmer (not illustrated) may be further provided to even the developer layer formed on the surface of the developing device 104*b*. Since the developing device 104*b* may have a magnetic roller therein, a magnetic carrier to which the toner is attached can be attached onto the developer device 104*b*, thereby forming a developer layer.

If the image forming apparatus 100 is designed to perform a monochromatic printing, the developing unit 104 has only a black toner (K). Also, if the image forming apparatus 100 is designed to perform a color printing, four developing units (not illustrated) containing, for example, yellow (Y), cyan (C), magenta (M), and black (K) color toners, respectively, can be disposed around the photoconductive medium 102.

The intermediate transfer belt 105 can be driven in a single direction by the support rollers 106 disposed at opposite ends thereof. The toner image formed on the photoconductive medium 102 can be transferred to the intermediate transfer belt 105 by a bias voltage applied to the first transfer roller 107. If the developing units for the respective YCMK toners are provided, respective toner images of the YCMK colors are transferred to the intermediate belt 105, to form a multi-color toner image.

The toner image formed on the intermediate transfer belt 105 is transferred to printing paper P by a bias voltage applied to the second transfer roller 108, and fused onto the printing paper P by a fusing unit, such as a heating roller (not illustrated) and a pressure roller (not illustrated).

The cleaning blade 109 removes a developer remaining on the photoconductive medium 102 after the toner image is transferred from the photoconductive medium 102 to the intermediate transfer belt 105, and evens the surface of the photoconductive medium 102.

The power supply unit 110 can supply a high voltage to the charging roller 101, the laser scanning unit 103, the developing device 104*b*, and the supply roller 104*c*, respectively, under the control of the controller 150.

The first driving unit 111 controls a rotational velocity of the photoconductive medium 102, whereas the second driving unit 112 controls a rotational velocity of the developing device 104*b*. If the rotational velocities of the photoconductive medium 102 and the developing device 104*b* are linear velocities, then the ratio of a linear velocity of the developing device 104*b* to a linear velocity of the photoconductive medium 102 can be referred to as a "velocity ratio". The "velocity ratio" is the rate at which the developing device 104*b* rotates, when the photoconductive medium 102 rotates a linear distance at a velocity of '1'. The first driving unit 111 and the second driving unit 112 may be controlled by the controller 150.

Figure 3:
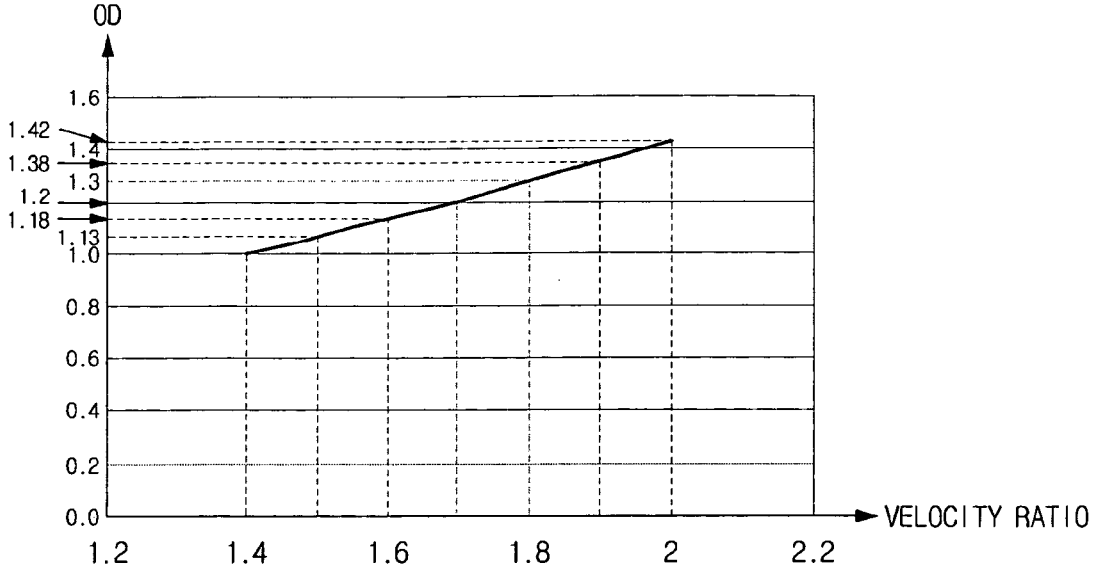
FIG. 3 is a graph illustrating a relationship between a velocity ratio and an optical density (OD)

For example, if both the photoconductive medium 102 and the developing device 104*b* rotate at a velocity of 100 m/s, the velocity ratio is '1', and if the photoconductive medium 102 rotates at a velocity of 100 m/s and the developing device 104*b* rotates at a velocity of 200 m/s, the velocity ratio is '2'. The velocity ratio increases if the velocity of the developing device 104*b* is greater than that of the photoconductive medium 102. That is, if the velocity ratio increases, the number of rotations of the developing device 104*b* is larger than the number of rotations of the photoconductive medium 102. Accordingly, the amount of developer which is transferred from the developing device 104*b* to the photoconductive medium 102 increases as the velocity ratio increases as illustrated in FIG. 3.

The counter 130 counts the number of times the pickup roller picks-up the fed printing paper.

The storage unit 140 stores a velocity ratio for a number of printed copies to control the velocity ratio of the developing device 104*b* to the photoconductive medium 102. The velocity ratio for the number of printed copies is calculated based on a variation amount of the optical density with respect to the number of printed copies (ΔOD) and a variation amount of the optical density (OD) with respect to a reference velocity ratio (ΔOD-reference velocity ratio), and can be stored in a look-up table form. The velocity ratio for the number of printed copies as stored is a control velocity ratio and is inversely proportional to the number of printed copies, and is used to control an actual velocity ratio in performing a printing operation.

Hereinafter, a process of calculating a velocity ratio for a number of printed copies will be described with reference to FIGS. 3 to 5.

FIG. 3 is a graph illustrating a relationship between a velocity ratio and an OD. Referring to FIG. 3, the velocity ratio is a driving velocity ratio of the developing device 104*b* to the photoconductive medium 102, and the OD is a density value of a basic pattern formed on the paper. In an experiment, a change in OD as the velocity ratio increases is measured from the printed paper through an experimental measuring instrument, such as an optical density meter. The OD can be proportional to the velocity ratio. That is, the OD increases as the velocity ratio increases. As the velocity ratio increases, a number of rotations of the developing device 104*b* increases to exceed that of the photoconductive drum 102, and thus, the amount of developer transferred from the developing device 104*b* to the photoconductive medium 102 increases.

FIGS. 4A and 4B are tables illustrating a variation amount of the OD with respect to a reference velocity ratio (ΔOD-reference velocity ratio).

The reference velocity ratio in FIG. 4A is one of several velocity ratios illustrated in the graph of FIG. 3, and represents a velocity ratio of the developing device 104*b* to the photoconductive medium 102 used in an initial driving operation. ΔOD-reference velocity ratio represents a difference between the OD corresponding to the reference velocity ratio used and an OD corresponding to each of the other several velocity ratios. For example, FIG. 4A illustrates an initial reference velocity ratio of '2.0', and $\Delta OD_{2.0}$ values for a difference between the OD value of '1.42' corresponding to the reference velocity ratio '2.0' and the respective OD values (for example, 1.39, 1.3) corresponding to the other several velocity ratios.

The table of FIG. 4B illustrates an initial reference velocity ratio of '1.4' and $\Delta OD_{1.4}$ values for differences between the OD value of '1.0' corresponding to the reference velocity ratio '1.4' and the respective OD values (for example, 0.9, 1.13, 1.18) corresponding to the other several velocity ratios.

Tables, such as the tables illustrated in FIGS. 4A and 4B, may be created according to the several reference velocity ratios. This is because the reference velocity ratios initially used may differ from each other according to the types of the image forming apparatus 100.

Figure 5:
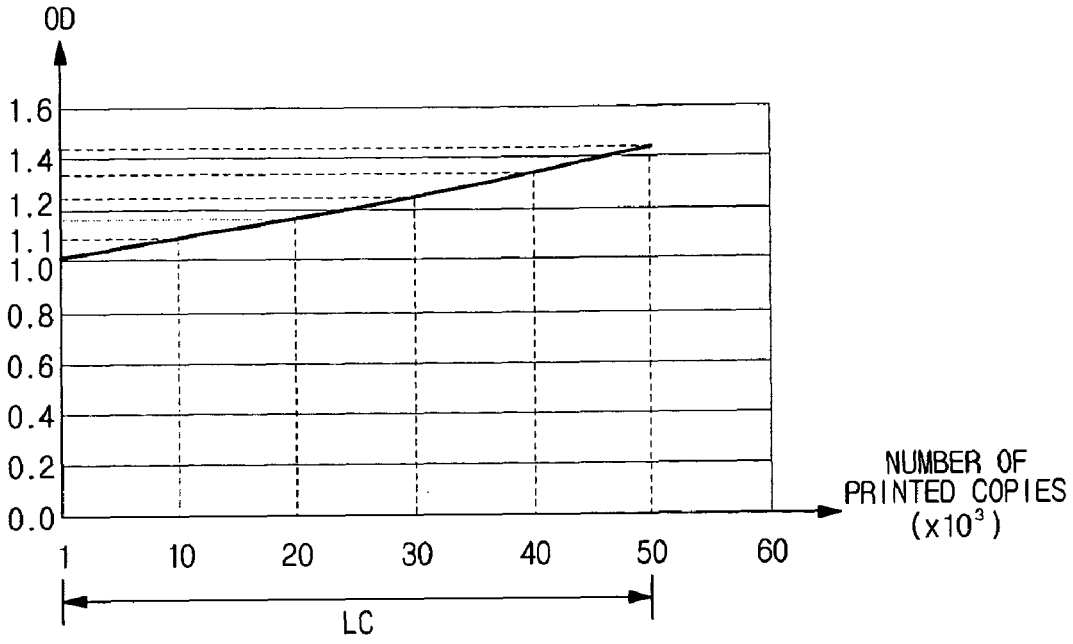
FIG. 5 is a graph illustrating a relationship between a number of printed copies and the OD.

FIG. 5 is a graph illustrating the relationship between a number of printed copies and an OD.

Referring to FIG. 5, the horizontal axis represents the number of printed copies. Here for example, '50' represents a maximum number of copies printable by an exemplary image forming apparatus 100 during its life cycle (LC), or during the life cycle of its printer engine components. The vertical axis represents an optical density (OD) value measured from the printed paper by an optical density measuring instrument. In FIG. 5, the OD varies by a decrease in an amount of electric charge as the number of printed copies increases and a decrease in a film thickness of the photoconductive medium 102 as the number of printed copies increases. That is, the OD is not maintained at a constant level and instead increases as the number of printed copies increases. A velocity ratio used in measuring the ODs for the numbers of copies is a part of experimental data and may a fixed value or a variable value.

FIG. 6 is a table illustrating the OD values for the different number of printed copies of FIG. 5 at a reference velocity ratio, and corresponding ΔOD values which increase as the number of printed copies increases.

In FIG. 6, 'OD' denotes an optical density value detected from a basic pattern formed on a printed paper, and 'ΔOD' denotes differences between OD values respectively calculated for the number of printed copies and a OD value measured when the number of printed copies is '1'. The ΔOD for the different number of printed copies can be calculated as illustrated in FIG. 6. A control velocity ratio for the number of printed copies is calculated based on the table illustrating ΔOD-reference velocity ratio with respect to a corresponding reference velocity ratio as illustrated in FIGS. 4A and 4B, and the table illustrating ΔOD for the number of printed copies as illustrated in FIG. 6. Herein, the corresponding reference velocity ratio is set to be used in the image forming apparatus 100 in the initial driving operation.

Referring to FIGS. 5 and 6, the OD is '1' when the number of printed copies is '1', and the OD is '1.1' when the number of printed copies is 10,000. Accordingly, ΔOD is '0.1' when the number of printed copies is 10,000, which means that the OD increases by '0.1' from the initial driving operation time.

If the developing device 104*b* and the photoconductive medium 102 are designed to initially rotate at a reference velocity ratio of '2.0', a control velocity ratio can be used to decrease the OD by 0.1 to compensate for the OD increase of 0.1 (ΔOD=0.1) when the number of copies is 10,000. For example, referring to FIG. 4A, at an initial reference velocity ratio of '2.0' a velocity ratio of '1.8' corresponds to a $\Delta OD_{2.0}$ value of about −0.12. Accordingly, the control velocity ratio of '1.8' most nearly corresponding to a $\Delta OD_{2.0}=-0.1$, and this control velocity ration can be stored as a table of control velocity ratios in the storage unit 140 as a control velocity ratio corresponding to 10,000 copies as follows.

TABLE 1

| Number of printed copies | Velocity Ratio (reference velocity ratio = 2.0) |
|---|---|
| 1 | 2.0 |
| . . . | . . . |
| 10,000 | about 1.81 |
| . . . | . . . |
| 20,000 | about 1.72 |
| . . . | . . . |
| 30,000 | about 1.6 |
| . . . | . . . |
| 40,000 | about 1.43 |
| . . . | . . . |
| 50,000 | about 1.4 |

Briefly, if a reference velocity ratio used in the image forming apparatus 100 in the initial driving operation is set to be '2.0', an $\Delta OD_{2.0}$ value corresponding to or nearly corresponding to −|ΔOD| of the ΔOD value illustrated in FIG. 6 is determined with reference to the table of FIG. 4A, by a designer or according to a program. A control velocity ratio corresponding to the determined $\Delta OD_{2.0}$ values to correspond with the number of printed copies can be stored in the storage unit 140 as illustrated in Table 1.

Also, the storage 140 may be designed to store all of 'number of printed copies' and "the reference velocity ratio (2.0), the reference velocity ratio (1.4)," and the other reference velocity ratios (not illustrated) as illustrated in FIG. 6.

The controller 150 can control the entire operations of the above-described units using a control program and a firmware stored in a non-volatile memory, such as ROM (not illustrated). For example, the controller 150 can control the power supply unit 110 to supply a voltage to the laser scanning unit 103 and the charging roller 101 to perform an image work such that an electrostatic latent image corresponding to an image is formed on the surface of the photoconductive medium 102. Also, the controller 150 can control the power supply unit 110 to supply a voltage to the supply roller 104*c* and the developing device 104*b* to supply toner from the developing device 104*b* to the portion of the photoconductive medium 102 where the electrostatic latent image is formed.

Also, the controller 150 can check a reference velocity ratio previously set in the ROM (not illustrated), and can output a frequency clock corresponding to the reference velocity ratio to the first driving unit 111 and the second driving unit 112. Based on the incoming frequency clock, the first driving unit 111 and the second driving unit 112 drive the photoconductive medium 102 and the developing device 104*b*, respectively, such that they rotate at the reference velocity ratio.

The controller 150 can then determine a total number of printed copies as a result of accumulating the number of printed copies counted by the counter 130 and can control the velocity of the developing device 104*b* to decrease as the accumulated number of printed copies increases and thus the velocity ratio of the developing device 104*b* to the photoconductive medium 102 also decreases.

In order to decrease the velocity ratio, for example, the velocity ratio can be controlled based on the velocity ratio for the number of printed copies stored in the storage unit 140. More specifically, the controller 150 can determine a velocity ratio corresponding to the number of printed copies determined by the counter 130 with reference to the storage unit 140, and accordingly controls the first driving unit 111 and the second driving unit 112 such that the photoconductive medium 102 and the developing device 104 are driven at the determined velocity ratio. That is, the controller 150 can output a frequency clock corresponding to the determined velocity ratio to the first driving unit 111 and the second driving unit 112 such that the velocity ratio decreases.

The controller 150 may not determine the velocity ratio every time that the number of printed copies increases, and may determine the velocity ratio at the time when the number of printed copies reaches a predetermined number. For example, the controller 150 may determine the velocity ratio every time 1,000 copies or 10,000 copies are printed.

As a result, the controller 150 can decrease the control velocity ratio when the number of printed copies increases such that the OD can be maintained within a predetermined range. If the control velocity ratio decreases, the velocity of the developing device 104*b* decreases such that the amount of toner transferred from the developing device 104*b* to the photoconductive medium 102 does not increase. Accordingly, a constant OD can be maintained and also a scattering problem can be reduced.

Figure 7:
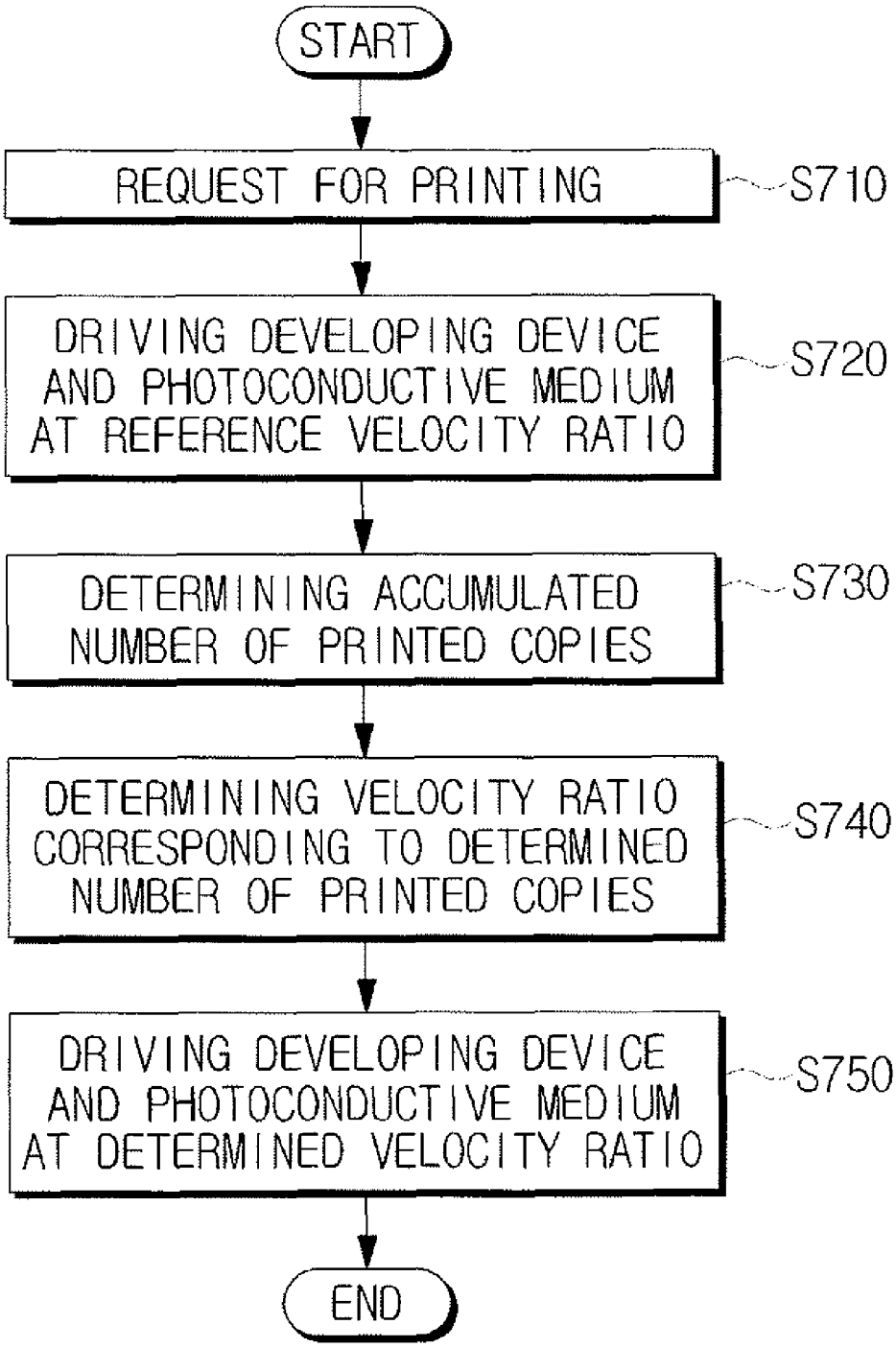
FIG. 7 is a flowchart illustrating a method to control a velocity ratio of the image forming apparatus of FIG. 1.

FIG. 7 is a flowchart illustrating a method to control a velocity ratio of the image forming apparatus of FIG. 1.

Referring to FIGS. 1 to 7, if a printing operation is requested in operation S710, the controller 150 controls the first driving unit 111 and the second driving unit 112 to drive the photoconductive medium 102 and the developing device 104*b*, respectively, at a pre-set reference velocity ratio in operation S720. In operation S720, the controller 150 controls the power supply unit 110 to supply voltages to the charging roller 101, the laser scanning unit 103, the developing device 104*b*, and the supply roller 104*c*, thereby forming an image on the picked-up paper P.

The controller 150 determines a total number of printed copies by accumulating the number of printed copies counted by the counter 130 in operation S730.

The controller 150 determines a control velocity ratio corresponding to the number of printed copies determined in operation S730 based on a table stored in the storage unit 140 in operation S740, and controls the first driving unit 111 and the second driving unit 112 to drive the photoconductive medium 102 and the developing device 104*b* at the determined control velocity ratio in operation S750. Accordingly, the velocity ratio of the developing device 104*b* to the photoconductive medium 102 decreases from the initial reference velocity ratio.

Various embodiments of the present general inventive concept can be embodied as computer readable codes on a computer-readable medium. The computer-readable medium includes a computer-readable recording medium and a computer-readable transmission medium. The computer readable recording medium may include any data storage device suitable to store data that can be thereafter read by a computer system. Examples of the computer readable recording medium include, but are not limited to, a read-only memory (ROM), a random-access memory (RAM), CD-ROMs, magnetic tapes, floppy disks, optical data storage devices, and carrier waves (such as data transmission through the Internet). The computer readable transmission medium can be distributed over network coupled computer systems, through wireless or wired communications over the internet, so that the computer readable code is stored and executed in a distributed fashion. Various embodiments of the present general inventive concept may also be embodied in hardware or in a combination of hardware and software.

As described above, according to the present general inventive concept, the image forming apparatus and the method to control a velocity ratio thereof decreases the velocity ratio of the developing device 104*b* to the photoconductive medium 102 as the number of printed copies increases, thereby preventing an OD from increasing.

Also, according to the present general inventive concept, since the velocity of the developing device 104*b* is controlled to decrease as the number of printed copies increases, the amount of toner transferred from the developing device 104*b* to the photoconductive medium 102 does not increase. As a result, a scattering problem can be prevented.

Also, since the velocity ratios for the number of printed copies in the life cycle can be previously calculated and stored at an experiment or manufacturing stage, a problem of a load to calculate a velocity ratio in an actual printing operation can be solved. Also, the velocity ratio is more speedily and accurately controlled based on the velocity ratio previously stored for the number of printed copies.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a developing device to rotate opposite a photoconductive medium and to supply the photoconductive medium with a developer; and a controller to control a velocity ratio of the developing device to the photoconductive medium according to an accumulated number of printed copies such that as the accumulated number of printed copies increases, the controller decreases the velocity ratio by decreasing a velocity of the developing device.

2. The image forming apparatus as claimed in claim 1, further comprising:

a storage unit to store the velocity ratio of the developing device to the photoconductive medium for the number of printed copies, wherein the controller controls the velocity ratio based on the velocity ratio stored for the number of printed copies.

3. The image forming apparatus as claimed in claim 2, further comprising:

a driving unit to drive the developing device, wherein the controller determines a velocity ratio corresponding to the accumulated number of printed copies with reference to the storage unit, and controls the driving unit to drive the developing device at a velocity corresponding to the determined velocity ratio.

4. The image forming apparatus as claimed in claim 2, wherein the velocity ratio stored for the number of printed copies is inversely proportional to the number of printed copies.

5. The image forming apparatus as claimed in claim 2, wherein the velocity ratio stored for the number of printed copies is calculated based on a variation amount of an optical density (OD) with respect to the number of printed copies, and a variation amount of the OD with respect to a velocity ratio.

6. The image forming apparatus as claimed in claim 1, further comprising:

a counter to count the accumulated number of printed copies.

7. A method to control a velocity ratio of an image forming apparatus, the method comprising:

supplying developer to a photoconductive medium using a rotating developing device facing the photoconductive medium; and controlling a velocity ratio of the developing device to the photoconductive medium according to an accumulated number of printed copies, including decreasing a velocity of the developing device as the accumulated number of printed copies increases.

8. The method as claimed in claim 7, further comprising:

storing the velocity ratio of the developing device to the photoconductive medium for the number of printed copies, prior to supplying the developer, wherein the controlling of the velocity ratio comprises controlling the velocity ratio based on the velocity ratio stored for the number of printed copies.

9. The method as claimed in claim 8, wherein the controlling of the velocity ratio comprises:

determining a velocity ratio corresponding to the accumulated number of printed copies with reference to the velocity ratio stored for the number of printed copies; and driving the developing device at a velocity corresponding to the determined velocity ratio.

10. The method as claimed in claim 8, wherein the velocity ratio stored for the number of printed copies is inversely proportional to the number of printed copies.

11. The method as claimed in claim 8, wherein the velocity ratio stored for the number of printed copies is calculated based on a variation amount of an optical density (OD) with respect to the number of printed copies, and a variation amount of the OD with respect to a velocity ratio.

12. The method as claimed in claim 7, further comprising:

counting the accumulated number of printed copies, wherein the controlling of the velocity ratio comprises determining the accumulated number of printed copies based on the result of counting the number of printed copies.

13. An image forming apparatus, comprising:

a photosensitive medium to form a latent image;

a developing unit to develop the latent image;

a counter to count the number of images formed; and a controller to decrease a velocity ratio of the developing unit to the photosensitive medium as a number of images formed increases.

14. The image forming apparatus of claim 13, further comprising:

a storage unit to store a plurality of control velocity ratios corresponding to a change in optical density with respect to an initial velocity ratio and a plurality of values representing an increase in optical density according to an increase in a number of images formed, wherein the controller decreases the initial velocity ratio to one of the plurality of control velocity ratios such that a decrease in optical density due to changing the initial velocity ratio to the control velocity ratio compensates for the increase in optical density due to the increase in the number of images formed.

15. A method to control a velocity ratio of a developing device to a photoconductive medium usable in an image forming apparatus, the method comprising:

determining a plurality of control velocity ratio corresponding to changes in optical density of an image formed with respect to an initial velocity ratio;

determining an increase in optical density according to an increase in a number of images formed; and selecting a control velocity ratio to change the initial velocity ratio to the selected control velocity ratios such that the change in optical density due to the change in velocity ratio compensates for the increase in optical density due to the increase in the number of images formed.

16. The method of claim 15, further comprising:

storing the plurality of control velocity ratios and values representing the increase in optical density according to the increase in the number of images formed; and using the stored values and control velocity ratios to select the control velocity ratio.

17. The method of claim 16, wherein the stored values and control velocity ratios are pre-installed in the image forming apparatus.

18. A method of controlling a velocity ratio of an image forming apparatus, comprising:

controlling a developing device and a photosensitive medium to rotate at a first velocity ratio;

counting a number of images formed; and controlling the developing device and the photosensitive medium to rotate at a second velocity ratio, wherein a change in optical density of the image formed due to a change in the velocity ratio compensates for an increase in optical density due to an increase in the number of images formed.

* * * * *